US005366120A

United States Patent [19]

Tollasepp

[11] Patent Number: 5,366,120

[45] Date of Patent: Nov. 22, 1994

[54] PAINT PUMP

[76] Inventor: Tonis Tollasepp, 120 Applefield Dr., Scarborough, Ontario, Canada, M1P 3Y2

[21] Appl. No.: 229,789

[22] Filed: Apr. 19, 1994

[51] Int. Cl.[5] ..... B67D 5/40

[52] U.S. Cl. ..... 222/377; 222/385; 222/529

[58] Field of Search ..... 222/209, 321, 336, 340, 222/377, 385, 528, 529

[56] References Cited

U.S. PATENT DOCUMENTS

| | | | |
|---|---|---|---|
| 667,588 | 2/1901 | Sheldon | 222/385 X |
| 987,970 | 3/1911 | Earl | 222/377 X |
| 2,110,027 | 3/1938 | Santarelli et al. | 222/377 |
| 2,594,223 | 4/1952 | Santarelli | 222/377 X |
| 2,774,518 | 12/1956 | Greene | 222/209 |
| 3,084,872 | 4/1963 | Corning | 222/529 X |
| 3,160,330 | 12/1964 | Pollitt | 222/209 |
| 3,161,329 | 12/1964 | Fedit et al. | 222/385 X |
| 3,239,109 | 3/1966 | Santarelli | 222/385 X |

*Primary Examiner*—Kevin P. Shaver

[57] ABSTRACT

A paint container has a resiliently depressable lid. Depressing the lid actuates a piston to force paint into a rigid tube and the paint then flows into a connected flexible tube. Backward flow of paint in the tube is inhibited during the upward stroke of the lid so that a pumping action is achieved.

6 Claims, 3 Drawing Sheets

Figure 1:
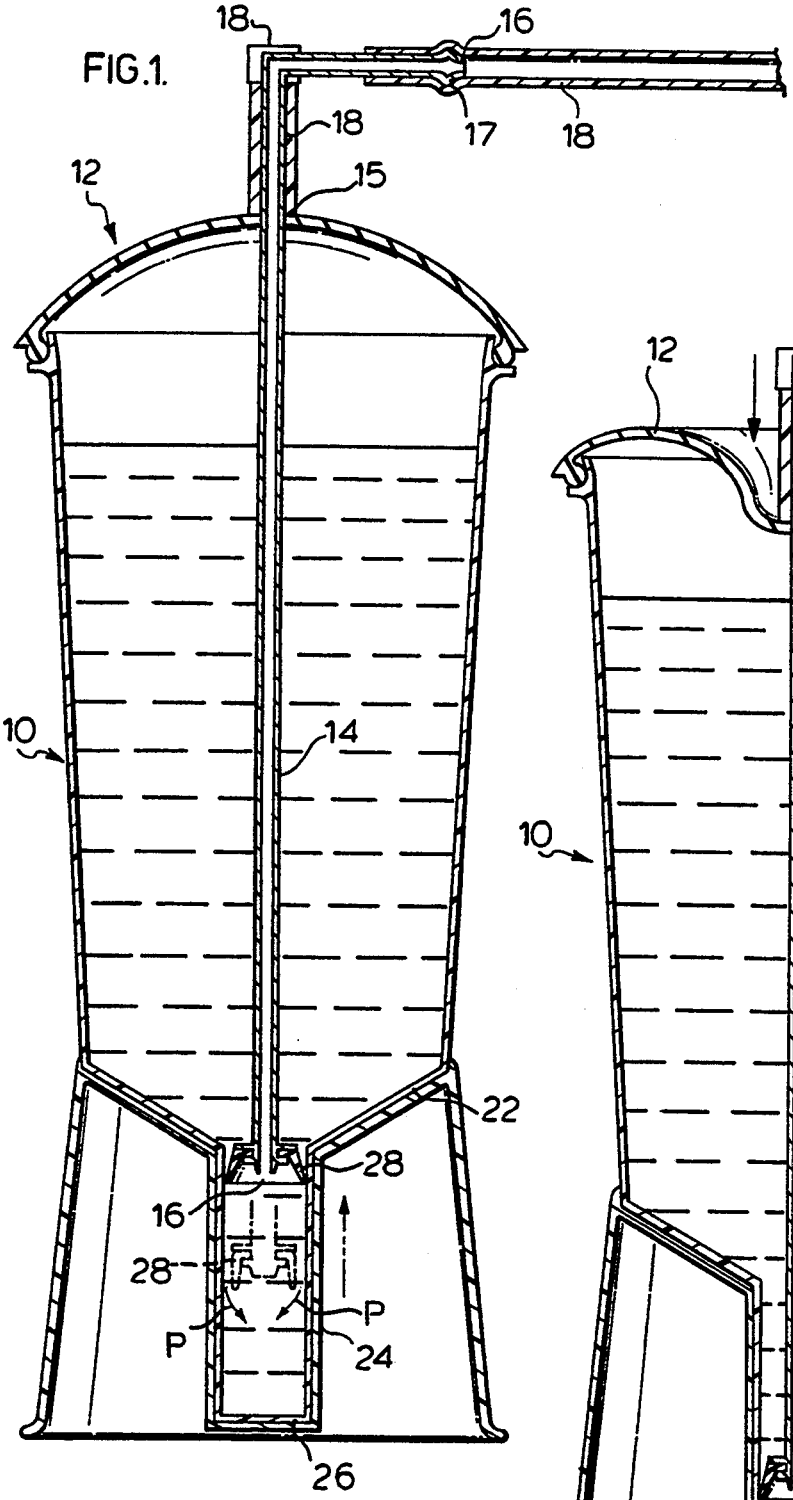

FIG. 4.
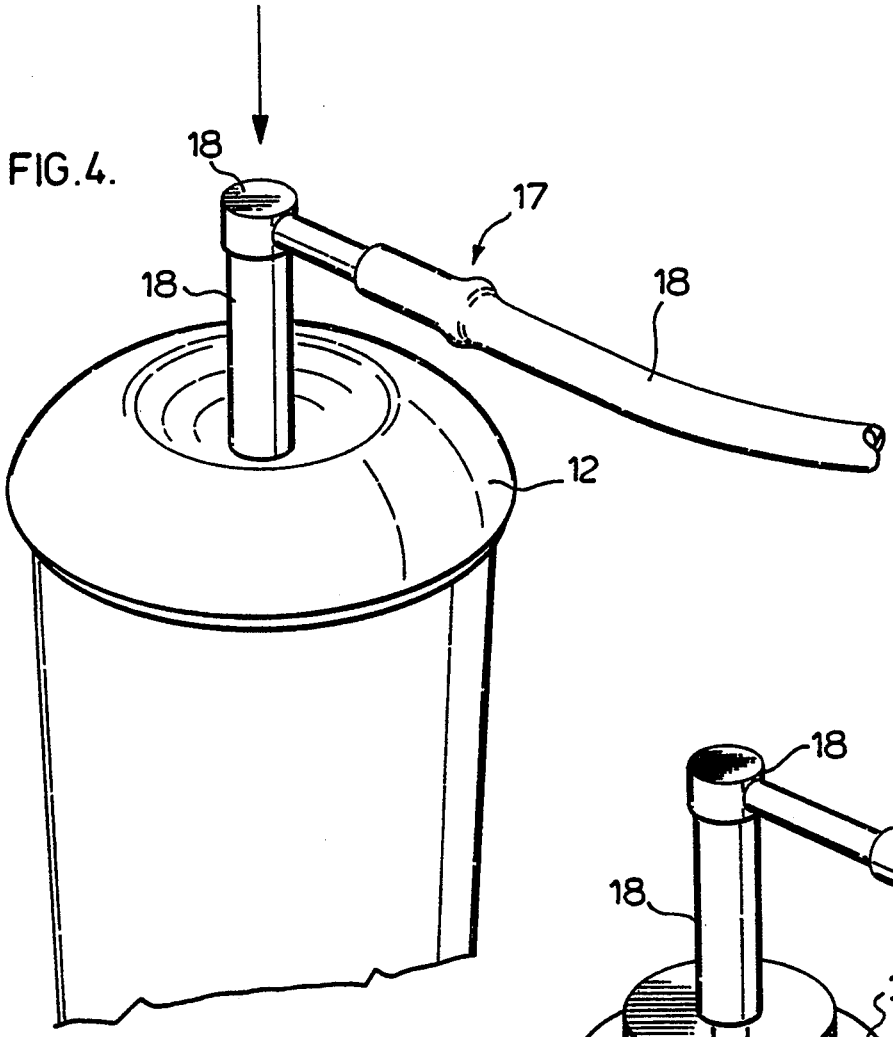
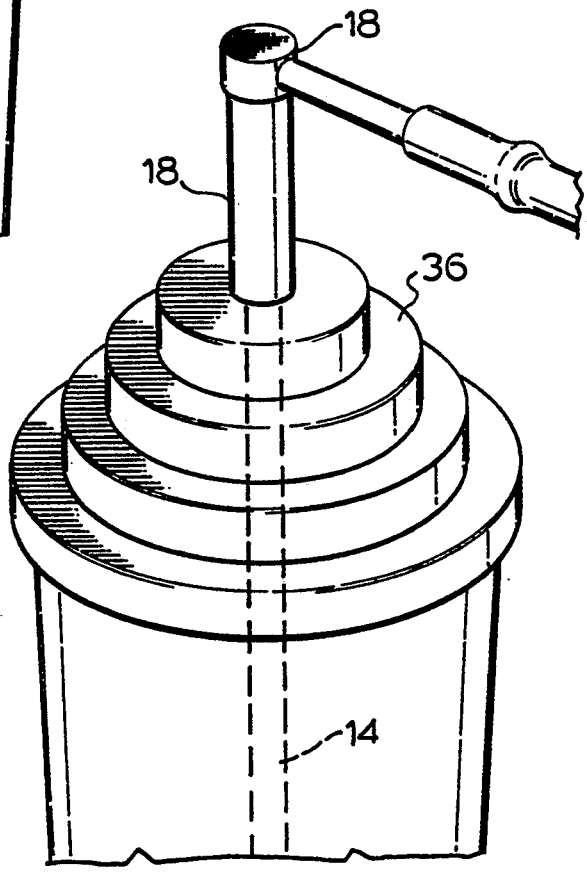
FIG. 7.

PAINT PUMP

This invention relates to a paint pump.

It is the object of this invention to provide a paint pump for the selective supply of paint, to a paint roller, or paint pad.

It is an object of this invention to provide a paint pump for the selective supply of paint from a container wherein the container has a resiliently deflectable lid and wherein the lid is used as the return spring in the pumping action.

It is an object of this invention to provide a paint pump as described in the previous paragraph, wherein the viscosity of the paint assists the operator of the paint pump.

By 'one-way' means herein I mean any device which relatively easily allows the flow of paint in one direction therepast but impedes flow there past in the other direction.

The pump in accord with the invention comprises an open topped container, and a resilient lid attached to the top of said container at its periphery. There is a central location of the lid. The lid so attached is adapted to assume a rest attitude, providing an upper portion for said central location and a deflected attitude providing a lower position for said central location. The lid when deflected is resiliently biased toward rest position. The upper and lower positions define a stroke direction. A rigid tube extends upwardly out of the lid and is coupled for movement therwith and extends downwardly to an open end adjacent the bottom of the container. Cooperating means between the rigid tube and the container provides that more paint is transferred from the container to tube, during the downstroke, than is transferred from the tube to the container during the upstroke. Accordingly a pumping action is provided where manual pressure on the lid deflects it for the downstroke, and the lid provides the spring action for the upstroke. A pumping action is produced in which only a single one way control is required, since the viscosity of the paint inhibits the travel of the paint, inhibits its travel downwardly through the rigid tube.

In a preferred form of the invention the single one way control is preferably provided by a flexible piston surrounding the tube, and located near its lower end, which rides in an upwardly open piston cylinder, extending downwardly from the bottom of the container. The flexible piston rides on the walls of the cylinder, during the downstroke, forcing paint into the rigid tube for passage upwardly therethrough. During the upstroke the piston pulls away, somewhat, from the piston wall allowing the (relative) downward flow of paint therepast from the main body of the container. Although the upward movement of the piston in the cylinder has some tendency to such paint back from the tube into the cylinder, the viscosity of the paint inhibits this so that most of the paint refilling the cylinder comes from the body of the container. The pumping is thus convenient, reasonably efficient, and the need for a second one way control in the rigid tube is avoided.

In a preferred form of the invention described in the preceding paragraph the rigid tube outside the container is connected to a resiliently flexible tube. Adjustable flow restricting means are, in this embodiment, provided on the flexible tube so that the correct flow resistance may be applied, given the viscosity of the paint then being used, to reduce back flow in the flexible and rigid tubes on the upstroke of the pump.

Figure 2:
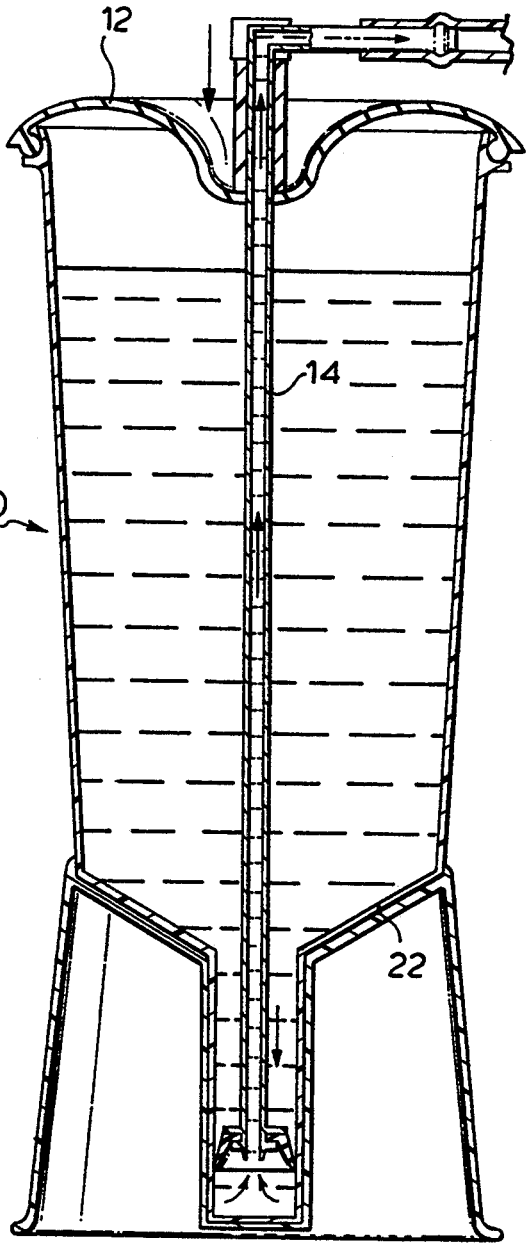
Figures 3, 5, 6:
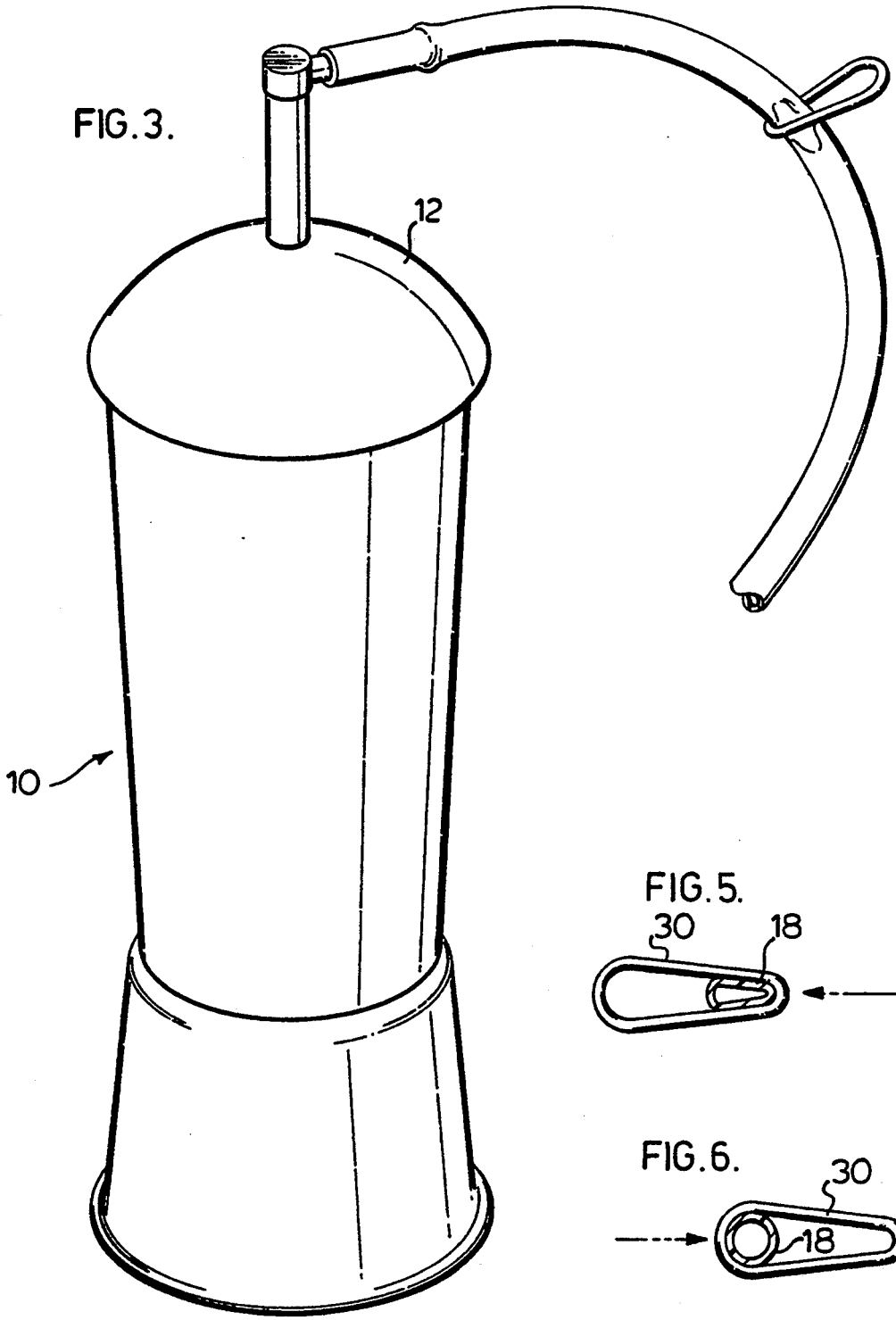

In drawings which illustrate preferred embodiments of the invention:

FIG. 1 is a vertical secion of a container in accord with pump of the invention at the upper end of its stroke, FIG. 2 is a vertical section of the container with the pump of the invention near the lower end of the stroke, FIG. 3 is a perspective view of the container of FIG. 1 at the upward end of its stroke, FIG. 4 is a partial perspective view of the container of FIG. 1 at the lower end of the stroke, FIGS. 5 and 6 are sections showing the flexible tube flow restriction means, FIG. 7 is a perspective view of an alternate form of the invention.

In FIG. 1 a paint container 10 which is preferably a body of revolution has a resilient rubber lid 12 (which may equally be of resilient plastic) which is peripherally connected to the container and which is connected to allow pivotting between these members about axes perpendicular to the radii of the body.

The lid 12 is shaped to be domed in its rest position and is constructed to be biased back to the rest position when deflected downwardly as shown in FIG. 2.

A rigid tube 14 passes through the lid and extends downwardly to an downwardly open end 10 which will be described hereafter.

The tube 14 extends upwardly at 15 out of a central location on and into a right angle turn to stub end 16. A sleeve 18, permanently attached to the lid surrounds the portion 15 of the tube outside the container and extends about an inner portion tube end 16. It will be noted that this arrangement effectively couples the tube and the lid so that they will move upwardly and downwardly together. It should be noted that any other arrangement which couples the rigid tube to the lid is equally useful to the purposes of the invention.

At its output end stub end 16 is provided with an outwardly facing bulge 17 to allow attachment of a resiliently flexible tube 18. As shown in FIGS. 5 and 6 a tapered ring 20 should be applied to the tube to adjustably restrict flow through the tube to a controllable degree. The constriction of the tube should increase as the viscosity diminishes.

Any other device to controllably restrict the flow may be used. At the lower end of the container the outer lower walls 22 are sloped inwardly from the periphery of the container to the upper end of a piston cylinder 24 having a closed lower end 26. The piston cylinder with walls 24 is vertically aligned with rigid tube 14. Rigid tube 14 is provided with a resiliently slightly flexible piston 28 sloping downwardly and outwardly from the outside of the tube to the cylinder walls. The flexible piston is dimensioned to contact the cylinder walls 24 on the downstroke (as in FIG. 2) and to deflect a small amount inward from the cylinder walls on the upstroke (see dotted profile in FIG. 1) to allow the travel of paint relatively downwardly therepast (see arrows p) during the upstroke of the piston.

In operation, the container is filled with paint, as shown.

The lid 12 is applied with attached tube 14 and piston extending into the cylinder. The lid assumes its upper, rest, position as shown in FIG. 1. The open end of flexible tube is directed to the paint roller or pad.

The pump is operated by alternating manual downstrokes on the lid, with upstrokes produced by removing the downward manual pressure and allowing the spring-action of the lid to move itself and the attached tube and piston to upper position. The control comprising of flexible tube may be at a preset location.

On the downstroke, piston 28 forces paint from cylinder 10 into the open lower end 16 of tube 14, up the tube and out flexible tube 18 into a paint roller or pad.

On the upstroke, the piston 28 flanges tend to pull away from the walls 24 of the cylinder and paint flows past the piston from the main body of the container downwards into the cylinder, impelled by suction and the weight of the paint. ON the upstroke there is some tendency for the paint in the rigid and flexible tubes to be sucked back into the cylinder. However the amount of paint sucked back out of the tube 14 is small, relative to the amount then entering the cylinder from the main body of the container. The amount of paint sucked back is controlled by the flow control in FIGS. 5 and 6. This is because, the viscosity of the paint combined with the narrowness of tubes 14 and 18 inhibits such back flow. Optimum conditions for restriction of flexible tube 18 will, to a small degree, limit outward flow during the piston downstroke. However such outward flow will still be found satisfactory since during the downstroke the paint is impelled by piston 28.

It should be noted that the pump as described lends itself to convenient connection to shoulder straps (not shown) whereby the user may conveniently carry the pump, while operating it.

FIG. 7 demonstrates that the resilient rubber domed top of FIG. 1 may be replaced by a concentricially stepped resilient plastic top 36. The stepped top is coupled to the container on the one hand and the rigid tube on the other in the same way as the domed top of FIG. 1. Among a number of shapes which could be used to achieve the purposes of the invention, the stepped shape is preferred as allowing efficient manual depression and self return during the downstrokes and upstrokes.

I claim:

1. Paint pump comprising:

a open-topped container;

a lid detachably attached to the top of said container at its periphery;

a central location on said lid;

said lid when so attached being adapted to assume a rest attitude, providing an upper position for said central location and a deflected attitude providing a lower position for said central location;

said lid, when deflected, being resiliently biased toward rest positon;

said upper and lower positions defining a stroke direction;

a rigid tube extending upwardly out of said lid at said location, and vertically movable therewith;

and extending downwardly to an opening adjacent to bottom of said container in said lower position;

one-way means cooperating between said tube and said container to cause transfer of an amount of paint from said container to said tube on the downstroke of said tube, which exceeds the amount of paint transferred from said tube to said container on the upstroke.

2. Paint pump as claimed in claim 1 wherein the bottom of said container is shaped to open into a piston cylinder extending downwardly therefrom, said cylinder having side walls substantially parallel to said stroke direction;

said one way means comprising a resiliently flexible piston attached to the outside of said tube which slopes downwardly from the locus of attachment, said piston moving in said cylinder and adapted to contact said cylinder walls on the downstroke to propel paint from said cylinder into the rigid tube, and allowing movement of paint relatively downwardly therepast on the upstroke.

3. Paint pump as claimed in claim 1 wherein said rigid tube is connected, outside of said lid, with a flexible resilient tube and means are provided for adjustably restricting paint passage through said flexible tube.

4. Paint pump as claimed in claim 2 wherein said rigid tube is connected, outside of said lid, with a flexible resilient tube and means are provided for adjustably restricting paint passage through said flexible tube.

5. Paint pump comprising:

an open topped container shaped to extend longitudinally in an approximately vertical direction, the bottom of said container being shaped to define a piston cylinder extending downwardly from the main body of said container;

a resiliently deformable lid for said container detachably attached to said container at the periphery of said lid;

said lid having a rest position and a downwardly deflected position and, when deflected, being resiliently biased toward rest position;

said lid defining a central portion having raised and lowered positions where said lid is in rest and deflected positions respectively;

a rigid tube extending through said central portion, coupled for movement therewith, and extending downwardly to an open end;

a flexible piston surrounding said tube adjacent said lower end adapted to ride in said cylinder;

said piston being adapted to ride on the wall of said piston cylinder during downward travel to impel paint from said cylinder into said tube, and being adapted to be spaced slightly from the wall of said cylinder during upward travel to allow paint to move relatively downwardly therepast.

6. Paint pump as claimed in claim 5, wherein said rigid tube is connected, outside said lid, with a flexible resilient tube and means are provided for adjustably restricting paint passage through said flexible tube.

* * * * *